US007861689B2

(12) United States Patent
Haug et al.

(10) Patent No.: US 7,861,689 B2
(45) Date of Patent: Jan. 4, 2011

(54) METHOD FOR CONTROLLING AN INTERNAL COMBUSTION ENGINE

(75) Inventors: Thomas Haug, Straubing (DE); Lukas Hecktor, Regensburg (DE); Roland Lang, Aiterhofen (DE)

(73) Assignee: Continental Automotive GmbH, Hannover (DE)

( * ) Notice: Subject to any disclaimer, the term of this patent is extended or adjusted under 35 U.S.C. 154(b) by 257 days.

(21) Appl. No.: 12/123,953

(22) Filed: May 20, 2008

(65) Prior Publication Data

US 2008/0289602 A1 Nov. 27, 2008

(30) Foreign Application Priority Data

May 21, 2007 (DE) ..... 10 2007 023 558
May 25, 2007 (DE) ..... 10 2007 024 415

(51) Int. Cl.
*F02P 5/00* (2006.01)
*F02P 1/00* (2006.01)

(52) U.S. Cl. ..... 123/406.21; 123/406.59; 123/609

(58) Field of Classification Search ..... 123/406.21, 123/406.59, 435, 609, 630
See application file for complete search history.

(56) References Cited

U.S. PATENT DOCUMENTS 4,494,509 A * 1/1985 Long ..... 123/406.19
4,697,561 A * 10/1987 Citron ..... 123/339.14
RE34,183 E * 2/1993 Wilens et al. ..... 123/406.19
5,626,120 A * 5/1997 Akatsuka ..... 123/479
5,632,247 A 5/1997 Hashizume et al. ..... 123/425
5,706,783 A * 1/1998 Sawada ..... 123/406.47
5,713,334 A * 2/1998 Anamoto ..... 123/491
5,762,053 A * 6/1998 Anamoto ..... 123/674
5,813,390 A * 9/1998 Anamoto ..... 123/674
5,827,150 A * 10/1998 Mukumoto ..... 477/101
6,691,023 B2 * 2/2004 Fujino et al. ..... 701/114

FOREIGN PATENT DOCUMENTS

DE 19544720 11/1995
DE 19859310 12/1998
DE 10234252 7/2002
DE 102006015662 4/2006
EP 0819925 7/1997

OTHER PUBLICATIONS

S. Münzinger; "Das Phänomen Glühzüngung"; in MTZ Nov. 2002, pp. 916-924, 2002.

* cited by examiner

*Primary Examiner*—John T Kwon
(74) *Attorney, Agent, or Firm*—King & Spalding L.L.P.

(57) ABSTRACT

A method for controlling an internal combustion engine with at least two cylinders in the case of irregular running caused by combustion problems has the following steps: measurement of a segment time of a first cylinder during a first time interval T1 in the sequence of operations of the internal combustion engine, with a corresponding first signal being transmitted as a first actual value to a control, sensing of pressure fluctuations in the second cylinder during a second time interval T2 in the sequence of operations of the internal combustion engine, with a corresponding second signal being transmitted as a second actual value to a control and changing of operating parameters of the at least one cylinder by means of the control on the basis of the first and second signal, when the first and the second actual value each deviate from setpoint values stored in the control.

14 Claims, 3 Drawing Sheets

METHOD FOR CONTROLLING AN INTERNAL COMBUSTION ENGINE

CROSS-REFERENCE TO RELATED APPLICATIONS

This application claims priority to German Patent Application Number 10 2007 023 558.7 filed on May 21, 2007 and German Patent Application Number 10 2007 024 415.2 filed May 25, 2007, the contents of which are incorporated herein by reference in its entirety.

TECHNICAL FIELD

The present invention relates to a method for controlling an internal combustion engine with at least one cylinder in the case of irregular running caused by combustion problems.

BACKGROUND

A combustion problem in internal combustion engines can be, for example, the occurrence of so-called knocking combustion. With knocking combustion, the ignition of the fuel/air mixture first takes place normally via the sparking of a spark plug, with a flame front forming in the usual way. The, as a rule, high temperature and pressure increase in the cylinder can cause a self-ignition to occur at another point of the cylinder, which is extremely heated in an unwanted manner, with the development of a second flame front. The two flame fronts then collide with each other and cause a characteristic knocking noise.

In the case of an—unwanted—extreme heating of a point of the cylinder, it is also possible for so-called premature ignition or ignition by incandescence to occur, which in an unwanted manner initiates an ignition before the actual ignition point. Premature ignition, which is another combustion problem, can have a more destructive effect than knocking combustion, since premature ignition causes the temperature at the piston head to rise extremely so that the melting point of the piston material is reached after a few seconds only and hence the piston can be destroyed. In the case of premature ignition, the ignition point can no longer be controlled by the engine control. Parts subject to extreme heating in this way include discharge valves, spark plugs, sealing parts and deposits on these parts and the surfaces surrounding the combustion chamber.

To prevent the occurrence of combustion problems such as, for example, knocking combustion, the publication DE 10 2006 015 662 A1, for example, suggests using so-called knock sensors to detect noises in the internal combustion engine, with the noises for each combustion cycle serving to form cylinder-individual signals. Hereby, a monitored cylinder is switched off, i.e., for example, the fuel supply to this cylinder is interrupted when knocking due to premature ignition is present, i.e. when the current signal values which are specific for this cylinder exceed prespecified setpoint values.

Furthermore, a combustion problem can also manifest itself in a change to the so-called segment times of the crankshaft. The segment times describe the times required by the crankshaft during the working cycles of the individual cylinders to pass through prespecified angular degrees.

The measurement of the segment times for the detection of irregular running is described for example in the publication DE 19544720 C1. Here, in dependence on the measured segment times and after subjecting the measured segment times to correction factors reflecting mechanical inaccuracies of a rotational speed sensor for the measurement of the segment times, an irregular running value is determined and compared with prespecified setpoint values. On the basis of the comparison, corresponding changes are then made to operating parameters of the respective cylinders in order to suppress the irregular running.

It has been found to be a drawback of the method described in the prior art that it is not possible to achieve adequate recognition of the different types of combustion problems.

SUMMARY

According to an embodiment, an improved method for controlling an internal combustion engine with at least one cylinder with irregular running caused by combustion problems may comprise the steps of: measuring a rotational speed of the crankshaft during a compression cycle of the cylinder during a first time interval in the sequence of operations of the internal combustion engine, detecting a knock signal during a working cycle of the cylinder during a second time interval in the sequence of operations of the internal combustion engine, and recognizing an ignition of the cylinder when the rotational speed of the crankshaft is slowed compared to a reference value and due to the knock signal a knocking combustion has been detected.

According to a further embodiment, the internal combustion engine may comprise at least two cylinders, wherein in an ignition sequence a first cylinder lying in front of the second cylinder, and the method may comprise the following steps: measuring a segment time of a working cycle of the first cylinder during a first time interval during a compression cycle of the second cylinder, detecting of a knock signal during a working cycle of the second cylinder during a second time interval, and recognizing an ignition of the second cylinder, when the segment time of the first cylinder is extended compared to a reference value and knocking combustion is recognized at the second cylinder on the basis of the knock signal. According to a further embodiment, knocking can be recognized when the knock signal lies above a defined threshold. According to a further embodiment, ignition can be recognized when the segment time of the first cylinder is extended by a defined time period compared to a setpoint value. According to a further embodiment, the second time interval may be divided into several time intervals, and at least one time interval may exist before a top dead center and one time interval exists after the top dead center of the second cylinder. According to a further embodiment, in the case of internal combustion engines with several cylinders, the method may comprise the steps of: measuring the segment time, sensing pressure fluctuations and changing an operating parameter, wherein the steps being performed separately for each cylinder. According to a further embodiment, the step of changing of an operating parameter for the combustion process in the second cylinder may comprise one or more of the following: reduction or interruption of the fuel supply to the second cylinder, reduction of a boost pressure in the second cylinder, reduction of a fresh-gas filling of the second cylinder and cooling of the second cylinder by a fuel supply which is increased compared to the present operating point of the internal combustion engine.

BRIEF DESCRIPTION OF THE DRAWINGS

The following describes the invention with reference to figures, which show.

DETAILED DESCRIPTION

As stated above, according to an embodiment, a method for the recognition of ignition by incandescence of an spark-ignition internal combustion engine with at least one cylinder, which is connected to a crankshaft may comprise the following steps: measurement of a rotational speed of the crankshaft during a compression cycle of the cylinder during a first time interval (T1) in the sequence of operations of the internal combustion engine, detection of a knock signal (200) during a working cycle of the cylinder during a second time interval (T2) in the sequence of operations of the internal combustion engine, and recognition of ignition by incandescence of the cylinder when the rotational speed of the crankshaft is slowed compared to a reference value and knocking combustion is recognized on the basis of the knock signal.

For this, in a further development, a method may comprise the following steps: measurement of a segment time of a first cylinder during a first time interval T1 in the sequence of operations of the internal combustion engine, sensing of a knock signal of a second cylinder during a second time interval T2 in the sequence of operations of the internal combustion engine, with the first cylinder preceding the second cylinder in the ignition sequence.

One advantage consists in the fact that the measurement of a segment time and the sensing of pressure fluctuations, in each case based on a cylinder, provide a relatively reliable recognition of both combustion problems caused by knocking combustion and combustion problems caused by premature ignition. If there are any deviations from the respective setpoint values both with the measurement of the segment time in the time interval T1 and with the knock signal in the time interval T2, with, in the sequence of operations of the internal combustion engine, the first time interval T1 preceding the second time interval T2, it may be concluded that there is premature ignition in the second cylinder.

Preferably, the second time interval T2 is divided into a plurality of time intervals in order to sense the occurrence of knocking combustion in at least one of the time intervals. Hereby, the start and/or duration of a respective time interval can be varied.

The following considers an internal combustion engine with spark ignition comprising at least two cylinders. In the ignition sequence, the first cylinder is in front of the second cylinder. The internal combustion engine can be a four-stroke or two-stroke engine. The various embodiments of the method are also applicable to internal combustion engines with more than two cylinders, for example 4, 6 or 8 cylinders.

Figure 1:
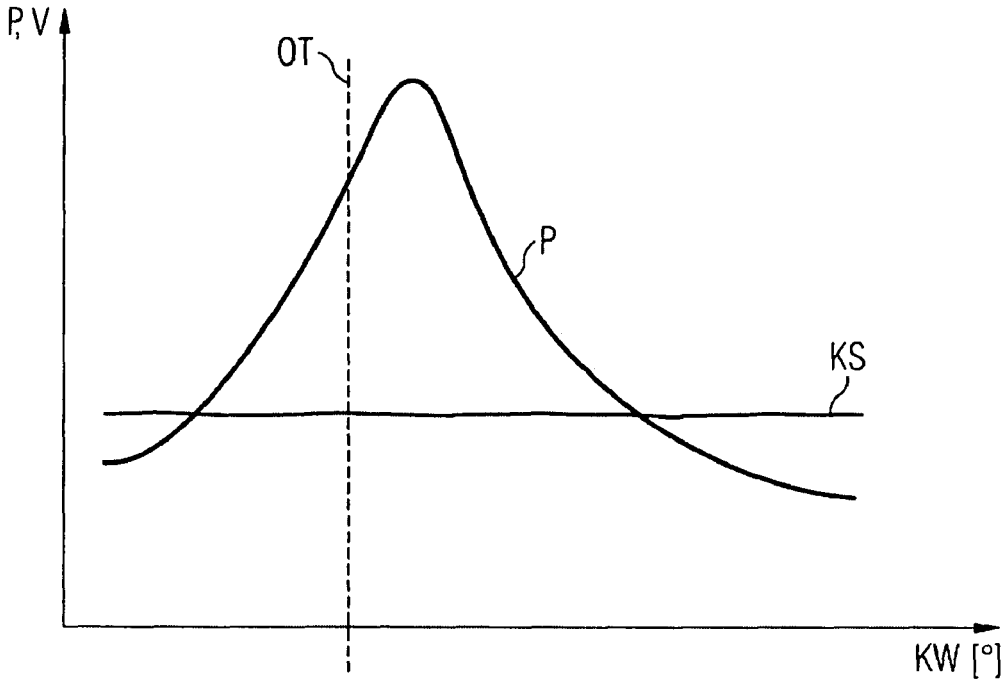
FIG. 1: a schematic diagram of the pressure curve with normal combustion in a combustion chamber in dependence on the crankshaft position

FIG. 1 shows a schematic diagram of the pressure curve P with normal combustion in a combustion chamber of the second cylinder in dependence on the crankshaft position ° KW. The graphical view also shows a knock-sensor signal KS of a conventional knock sensor, with, in this example, the knock-sensor signal KS extending substantially flat, since no knocking combustion takes place.

The maximum point of the graph P, that is the highest pressure in the combustion chamber, is achieved with a crankshaft position shortly after the top dead center TDC of the piston movement which is depicted in FIG. 1 by a perpendicular dashed line.

Figure 2:
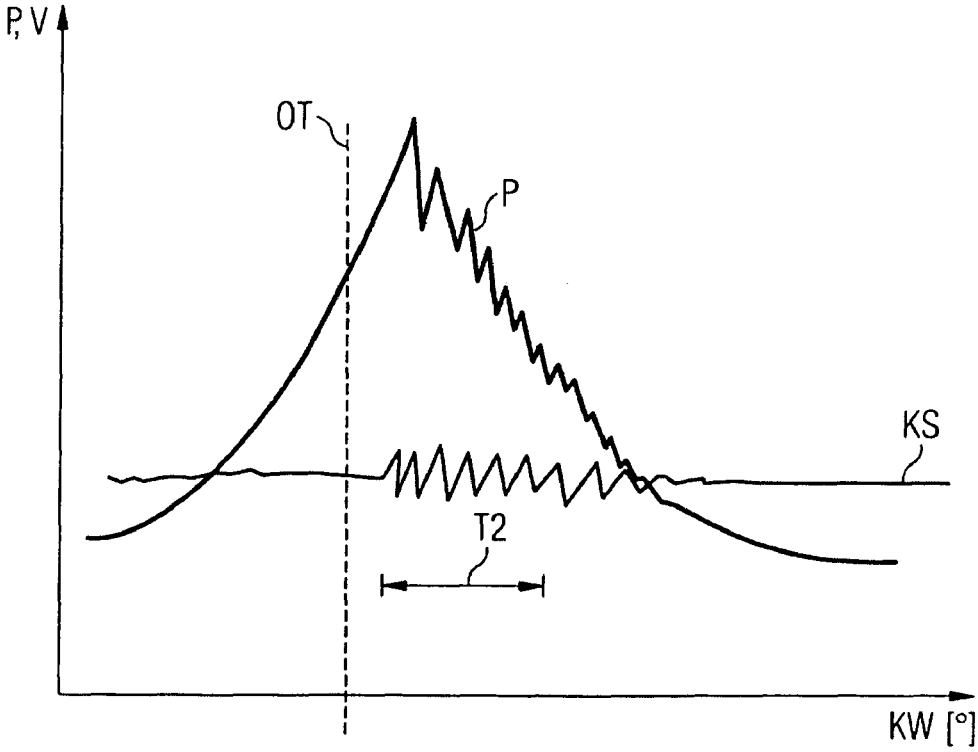
FIG. 2: a schematic diagram of the pressure curve with knocking combustion in a combustion chamber in dependence on the crankshaft position

FIG. 2 shows a schematic diagram of the pressure curve P with knocking combustion in the second cylinder. The pressure waves that form in the combustion chamber result in significant pressure fluctuations, which superimpose the graph P and are recorded by the knock sensor which issues an oscillating knock-sensor signal KS corresponding to the pressure fluctuations.

FIG. 2 also shows a time interval T2 in which the pressure fluctuations in the corresponding combustion chamber are sensed. As is evident, the time interval T2 is selected so that the pressure fluctuations that occur or any knocking during the combustion in the second cylinder can be recorded.

Figure 3:
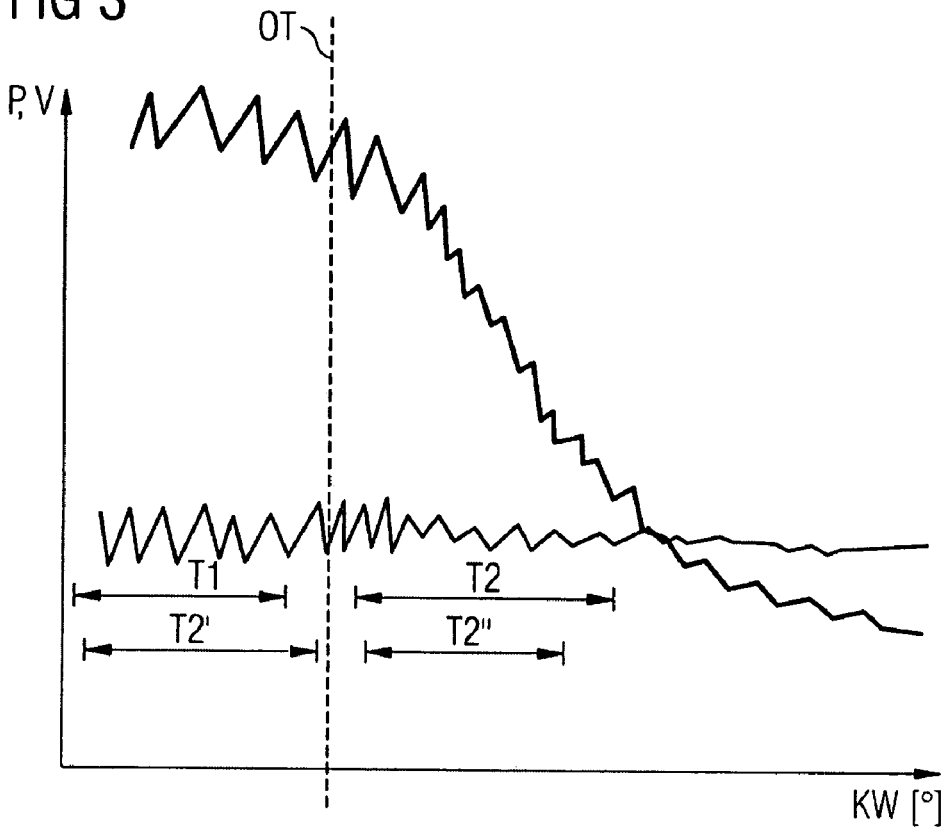
FIG. 3: a schematic diagram of the pressure curve with knocking combustion caused by premature ignition in a combustion chamber in dependence on the crankshaft position

FIG. 3 shows a schematic diagram of the pressure curve P with knocking combustion caused by premature ignition. Here, it is evident that there are a plurality of time intervals T2', T2" replacing the time interval T2 in FIG. 2 in order to be able in this way to record at a relatively early point pressure fluctuations in the combustion chamber caused by premature ignition, which with a time interval T2 as shown in FIG. 2 are only recorded at a very late time point. The start and duration of the time intervals T2', T2" can be varied optionally. The time intervals can be arranged before and after the top dead center TDC of the second cylinder, T2' preferably before T2" preferably after TDC.

In many cases, however, premature ignition shifts to even earlier time points relative to the top dead center TDC so that the time gap between the occurrence of premature ignition and the TDC is so large that there is no longer any development of pressure fluctuations and it is no longer possible to recognize the combustion problems caused by knocking combustion from the time intervals T2, T2' or T2".

Consequently, it is necessary to resort to another method for the recognition of combustion problems. This achieved by measuring the segment time of the first cylinder preceding the second cylinder in the combustion sequence, such as is described, for example, in the publication DE 195 44 720 C1. Segment time should be understood to mean the temporal duration required by the crankshaft in order to rotate about a defined angular degree, that is a defined segment. With a 6-cylinder four-stroke internal combustion engine, a cylinder segment can be, for example, 120°. The segment time of a cylinder is the time required by the crankshaft to cover the defined 120°. A cylinder segment can be, for example, a working cycle, that is a combustion cycle of the respective cylinder in which the inducted fuel is burnt. The cylinder segments of the individual cylinders are defined by corresponding markings on the crankshaft and assigned to the respective cylinders. On the occurrence of premature ignition, which takes place in the compression cycle of the second cylinder (n), the segment time of the first cylinder changes, with, however, it being possible for premature ignition to occur so early relative to the crankshaft position that the change to the segment time can be related to the cylinder (n-1) lying temporally in front of the cylinder in question in the combustion sequence. In order, however, to achieve a correct recognition of the occurrence of premature ignition, the change to the segment time must be assigned to the second cylinder (n). Therefore, a time interval T1 is set in the compression cycle of the second cylinder (n), during which the angular distance actually covered by the crankshaft (actual value) is compared with the theoretical angular distance (setpoint value) to be covered. This is measured, for example, using the segment time of the first cylinder during the combustion cycle of the first cylinder. If premature ignition occurs, the piston of the first cylinder is braked during the combustion cycle due to premature ignition in the induction cycle of the second cylinder thus resulting in an extending segment time for the first cylinder. Since a changed segment time on its own is not necessarily evidence of the occurrence of premature ignition since a deviation of the segment time from the setpoint could also be attributed to a mechanical error, a further condition used for the occurrence of premature ignition could also be the occurrence of knocking combustion in the combustion process of the second cylinder so that it is only possible to conclude that there is premature ignition for the combustion in the second cylinder when both a changed segment time in the time interval T1 and knocking combustion in the time interval T2 (or T2', T2") are recorded since premature ignition and the knocking combustion are mutually dependent. Instead of the evaluation of the segment time of the first cylinder, it is also possible to evaluate the rotational speed of the crankshaft in the compression cycle of the second cylinder. In the case of ignition by incandescence, the rotational speed of the crankshaft is reduced by a defined value compared to a setpoint value. The use of the segment time of the first cylinder has the advantage that this information is often already acquired due to the monitoring for misfiring and available to the control device.

Figure 4:
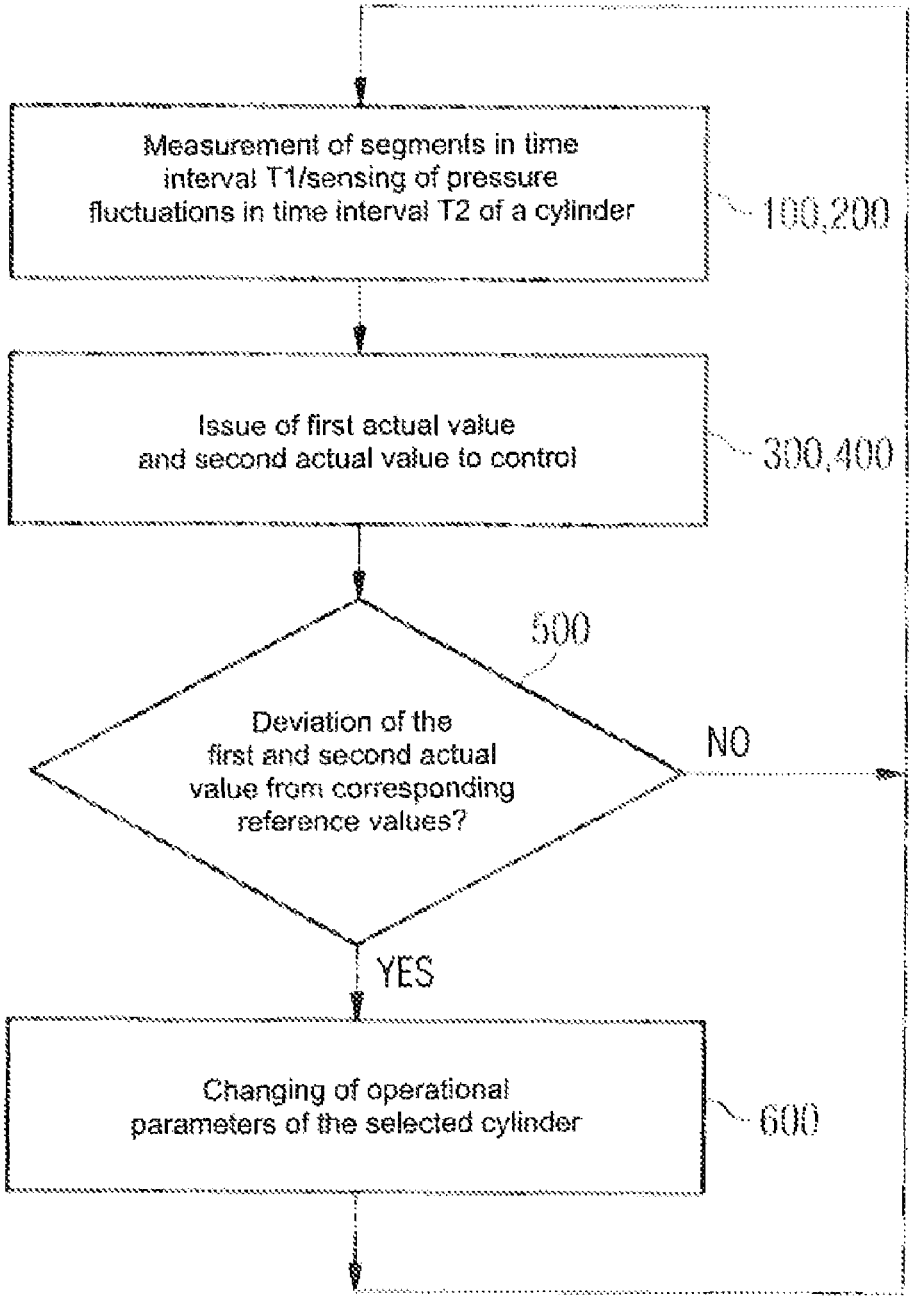
FIG. 4: a schematic diagram of the method according to an embodiment.

FIG. 4 now shows schematically the method according to an embodiment in the form of a flow routine. In steps 100 and 200, which correspond to the sensing of pressure fluctuations in a time interval T2 caused by knocking combustion in the second cylinder or the measurement of the segment time of the first cylinder in a time interval T1 caused by premature ignition, corresponding first and second signals are recorded. In steps 300 or 400, the first or second signals are issued as first or second actual values to a control and optionally stored where they are compared with corresponding setpoint values stored in the control in a step 500. The setpoint values correspond to the segment time of the first cylinder with normal combustion in the second cylinder and to a knock signal with normal combustion in the second cylinder. If there is no deviation from the setpoint values, there is a return to the start of the routine at the steps 100, 200. If there is a deviation from the setpoint values, the operating parameters of the cylinder in question are correspondingly changed in a step 600, wherein a change in the operating parameters can be an interruption to the fuel supply, a reduction of the boost pressure, a reduction of the fresh-gas filling or even the cooling of the corresponding cylinder by fuel in order to eliminate the irregular running caused by the combustion problems.

Premature ignition can occur in the compression cycle of a first cylinder and hence result in the slowing down of the speed of the cylinder. The ignition by incandescence can occur a long time before the ignition point of the first cylinder. The slowing down is, for example, recognized from a longer segment time of the first cylinder preceding the second cylinder in the ignition.

If, now, knocking combustion for the second cylinder is recognized and an extended segment time is measured for the first cylinder, this is evidence of ignition by incandescence for the combustion in the second cylinder.

Depending upon the selected embodiment, ignition by incandescence is only recognized if knocking combustion for the second cylinder was recognized both in the time interval before TDC and in the time interval after TDC. Hereby, different thresholds for the recognition of the knocking combustion can be used for the time interval before TDC and the time interval after TDC.

Depending upon the embodiment, different thresholds can be used for the recognition of an extended segment time. For example, the lower the threshold for the recognition of knocking combustion, the longer the extension time by which the segment time has to be extended for there to be evidence of ignition by incandescence, that is premature ignition.

What is claimed is:

1. A method for the recognition of premature ignition by incandescence of a spark-ignited internal combustion engine with at least one cylinder connected to a crankshaft, comprising the steps of:

measuring a rotational speed of the crankshaft during a compression cycle of the cylinder during a first time interval in the sequence of operations of the internal combustion engine, detecting a knock signal during a working cycle of the cylinder during a second time interval in the sequence of operations of the internal combustion engine, and identifying a premature ignition of the cylinder only if both (a) it is determined that the measured rotational speed of the crankshaft is slowed compared to a reference value and (b) a knocking combustion is detected based on the knock signal.

2. The method according to claim 1, wherein the internal combustion engine comprises at least two cylinders, wherein in an ignition sequence a first cylinder lying in front of the second cylinder, and wherein the method comprises the following steps:

measuring a segment time of a working cycle of the first cylinder during a first time interval during a compression cycle of the second cylinder, detecting of a knock signal during a working cycle of the second cylinder during a second time interval, and identifying a premature ignition of the second cylinder, only if both (a) it is determined that the measured segment time of the first cylinder is extended compared to a reference value and (b) knocking combustion is identified at the second cylinder on the basis of the knock signal.

3. The method according to claim 1, wherein knocking is identified when the knock signal lies above a defined threshold.

4. The method according to claim 2, wherein determining that the measured segment time of the first cylinder is extended compared to a reference value comprises determining that the measured segment time of the first cylinder is extended by a defined time period compared to a setpoint value.

5. The method according to claim 2, wherein the second time interval is divided into several time intervals, and at least one time interval exists before a top dead center and one time interval exists after the top dead center of the second cylinder.

6. The method according to claim 2, wherein the internal combustion engine includes multiple cylinders, and the method comprises the steps of: measuring the segment time, sensing pressure fluctuations and changing an operating parameter, said steps being performed separately for each cylinder.

7. The method according to claim 6, wherein the step of changing of an operating parameter for the combustion process in the second cylinder comprises at least one step selected from the group consisting of: reduction or interruption of the fuel supply to the second cylinder, reduction of a boost pressure in the second cylinder, reduction of a fresh-gas filling of the second cylinder, and cooling of the second cylinder by a fuel supply which is increased compared to the present operating point of the internal combustion engine.

8. An internal combustion engine coupled with a crankshaft operable to detect a premature ignition, comprising:

a first sensor for measuring a rotational speed of the crankshaft during a compression cycle of the cylinder during a first time interval in the sequence of operations of the internal combustion engine, and a second sensor for detecting a knock signal during a working cycle of the cylinder during a second time interval in the sequence of operations of the internal combustion engine, wherein the internal combustion engine is operable to identify a premature ignition of the cylinder only if both (a) it is determined that the measured rotational speed of the crankshaft is slowed compared to a reference value and (b) a knocking combustion is detected based on the knock signal.

9. The internal combustion engine according to claim 8, wherein the internal combustion engine comprises at least two cylinders, with in an ignition sequence a first cylinder lying in front of the second cylinder, wherein:

the first sensor is used to measure a segment time of a working cycle of the first cylinder during a first time interval during a compression cycle of the second cylinder, the second sensor is used to detect of a knock signal during a working cycle of the second cylinder during a second time interval, and the internal combustion engine is operable to identify a premature ignition of the second cylinder only if both (a) it is determined that the measured segment time of the first cylinder is extended compared to a reference value and (b) knocking combustion is identified at the second cylinder on the basis of the knock signal.

10. The internal combustion engine according to claim 8, wherein knocking is identified when the knock signal lies above a defined threshold.

11. The internal combustion engine according to claim 9, wherein determining that the measured segment time of the first cylinder is extended compared to a reference value comprises determining that the measured segment time of the first cylinder is extended by a defined time period compared to a setpoint value.

12. The internal combustion engine according to claim 9, wherein the second time interval is divided into several time intervals, and at least one time interval exists before a top dead center and one time interval exists after the top dead center of the second cylinder.

13. The internal combustion engine according to claim 9, comprising several cylinders, wherein the internal combustion engine is operable to measure the segment time, to sense pressure fluctuations and to change an operating parameter separately for each cylinder.

14. The internal combustion engine according to claim 13, wherein changing of an operating parameter for the combustion process in the second cylinder comprises at least one step selected from the group consisting of: reduction or interruption of the fuel supply to the second cylinder, reduction of a boost pressure in the second cylinder, reduction of a fresh-gas filling of the second cylinder, and cooling of the second cylinder by a fuel supply which is increased compared to the present operating point of the internal combustion engine.

* * * * *